US005813529A

United States Patent [19]

Goserud

[11] Patent Number: 5,813,529

[45] Date of Patent: Sep. 29, 1998

[54] MULTIFUNCTIONAL CAP FOR A STORAGE CONTAINER

[76] Inventor: J. Thomas Goserud, 3152 Woodridge Dr., Landisville, Pa. 17538

[21] Appl. No.: 880,794

[22] Filed: Jun. 23, 1997

Related U.S. Application Data

[63] Continuation-in-part of Ser. No. 580,611, Dec. 29, 1995, Pat. No. 5,641,064.

[51] Int. Cl.[6] ..... B65D 85/58

[52] U.S. Cl. ..... 206/315.1; 215/320; 215/228; 220/212; 220/254; 220/287

[58] Field of Search ..... 215/307, 320, 215/354, 228; 220/212, 367.1, 254, 287, 801; 206/315.1, 445

[56] References Cited

U.S. PATENT DOCUMENTS 4,393,976 7/1983 Maguire ..... 215/320 X 5,361,921 11/1994 Burns ..... 215/320

5,641,064 6/1997 Goserud ..... 206/315.1

*Primary Examiner*—Jacob K. Ackun

*Attorney, Agent, or Firm*—Norman B. Rainer

[57] ABSTRACT

A closure cap for a tubular container is formed as a monolithic plastic structure having a collar portion of circular configuration with respect to a center axis, and a flange transversely disposed to the axis and defining a circular aperture centered upon the axis. The collar portion has a doubly tapered outer surface which facilitates frictionally gripping engagement with the interior of the container or engagement with another cap of smaller size. Dual caps having multi-functional features are formed by the frictional interengagement of two caps.

10 Claims, 3 Drawing Sheets

MULTIFUNCTIONAL CAP FOR A STORAGE CONTAINER

RELATED APPLICATIONS

This Application is a continuation-in-part of U.S. patent application Ser. No. 08/580,611, filed Dec. 29, 1995, now U.S. Pat. No. 5,641,064.

BACKGROUND OF THE INVENTION

1. Field of the Invention

This invention relates to caps for storage containers, and more particularly concerns a multifunctional frictionally securable cap for a tubular container.

2. Description of the Prior Art

Various products such as golf balls, POG™ playing discs, candy, coiled poster prints and other consumer-oriented merchandise are often packaged in transparent plastic tubular containers which effectively display the contained merchandise. Such tubular containers find even further use in other applications for the storage, shipping, display and utilization of various items. Different types of caps or end plugs have been effectively utilized with tubular containers.

Parent application Ser. No. 08/580,611, filed Dec. 29, 1995 discloses frictionally securable closure caps for tubular containers, said caps having a centered aperture which permits additional functionality of the cap. Although some of the functional aspects of such caps have been described, additional functions are achievable, particularly by way of specialized construction of the closure cap.

It is accordingly an object of the present invention to provide a closure cap which is frictionally securable to a tubular container, said closure cap having a centered aperture which affords additional functionality.

It is another object of this invention to provide a closure cap as in the foregoing object constructed in a manner permitting interengagement of two such caps to provide additional functional aspects.

It is a further object of the present invention to provide an interengaged combination of two closure caps of the aforesaid nature.

It is a still further object of this invention to provide a container comprised of a tubular member having at least one closure cap of the aforesaid nature.

These objects and other objects and advantages of the invention will be apparent from the following description.

SUMMARY OF THE INVENTION

The above and other beneficial objects and advantages are accomplished in accordance with the present invention by a closure cap of monolithic construction for a tubular container, said cap comprising:

a) a collar portion of circular configuration with respect to a center axis, bounded by first and second extremities lying in parallel planes spaced apart in orthogonal relationship to said axis, an inner surface directed toward said axis and having a circular cylindrical contour with respect to said axis, and an opposed outer surface comprised of a first band portion convergently tapered toward said axis in the direction of said first extremity, and a second band portion convergently tapered toward said axis in the direction of said second extremity, said first and second band portions meeting in a circular apogee ridge representing the maximum diameter of said outer surface, and b) a flange transversely disposed to said axis and defining a circular aperture centered upon said axis and having a diameter smaller than the diameter of said inner surface, said flange having a perimeter directed outwardly from said axis and extending beyond said outer surface.

In another aspect of the present invention, a dual closure cap is provided having a first closure cap of the aforesaid nature engaged by a second closure cap of similar construction but smaller dimensions than said first closure cap wherein the diameter of the apogee ridge of said second cap is substantially equal to the diameter of the circular aperture of said first cap. The manner of interengagement of said caps is such that the collar portion of said second cap penetrates the central aperture of said first cap, and the flanges of both caps are in abutting relationship.

In a still further aspect of the present invention, a tubular container is provided which has at its upper extremity a dual closure cap of the aforesaid nature.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
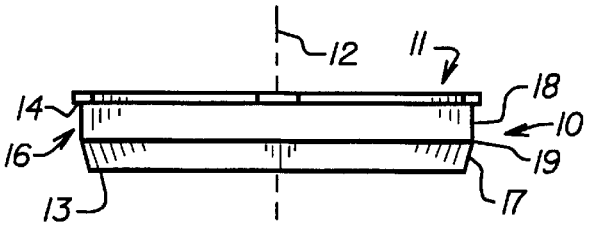
FIG. 1 is a side view of an embodiment of the closure cap of the present invention.

Referring to FIGS. 1–4, an embodiment of the closure cap of the present invention is shown as a monolithic structure fabricated of injection-moldable plastic and comprised of collar portion 10 and flange 11.

Collar portion 10 is of circular configuration with respect to center axis 12, and is bounded by first and second axial extremities 13 and 14, respectively, lying in parallel planes spaced apart in orthogonal relationship to said axis. Said collar portion is further defined by an inner surface 15 which faces said axis, and by an opposed outer surface 16. Said inner surface has a circular cylindrical contour with respect to said axis. Outer surface 16 is comprised of a first band portion 17 tapered toward said axis in the direction of said first extremity 13, and a second band portion 18 tapered toward said axis in the direction of said second extremity. Said first and second band portions meet in a circular apogee ridge 19 representing the maximum diameter of said outer surface.

Figure 4:
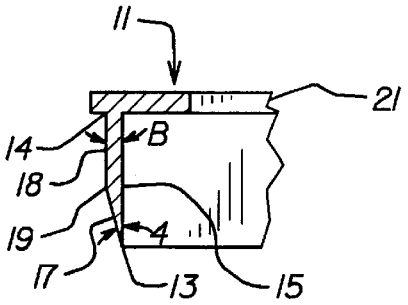
FIG. 4 is an enlarged sectional view taken in the direction of the arrows upon the line 4—4 of FIG. 2.
Figure 2:
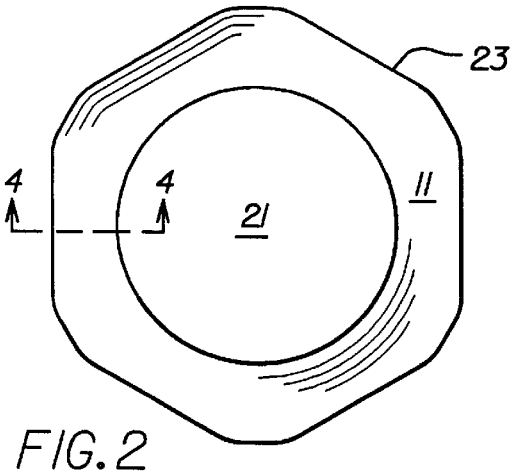
FIG. 2 is a top view of the cap of FIG. 1.
Figure 3:
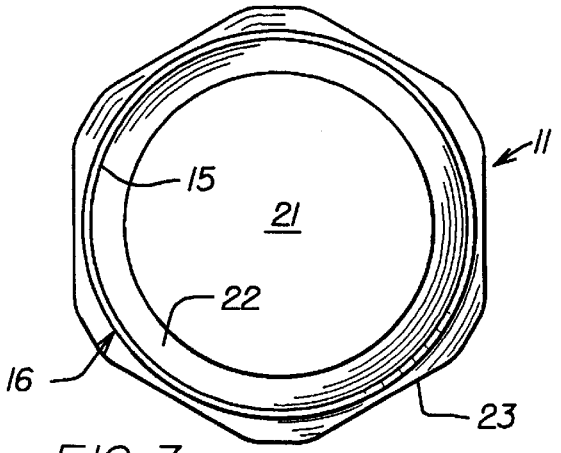
FIG. 3 is a bottom view of the cap of FIG. 1.
Figure 9:
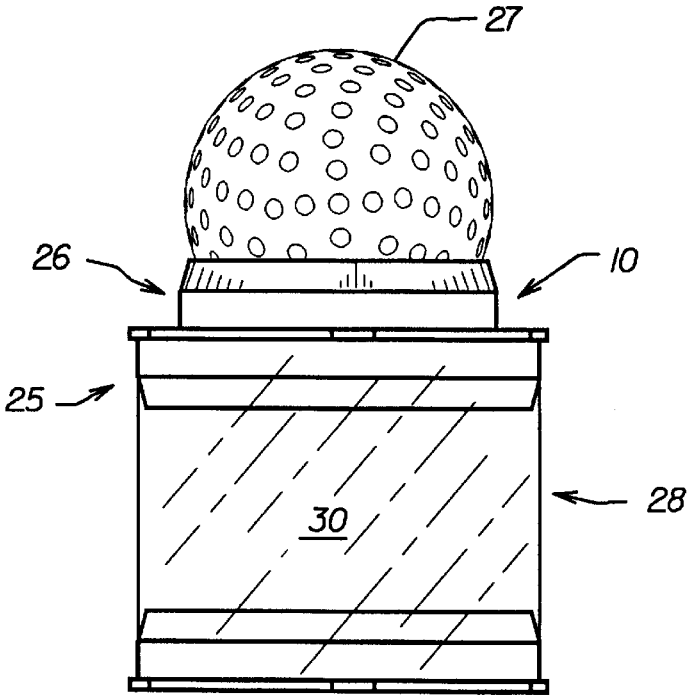
FIG. 9 is a side view of a first embodiment of a container having a dual closure cap of FIG. 5.
Figure 10:
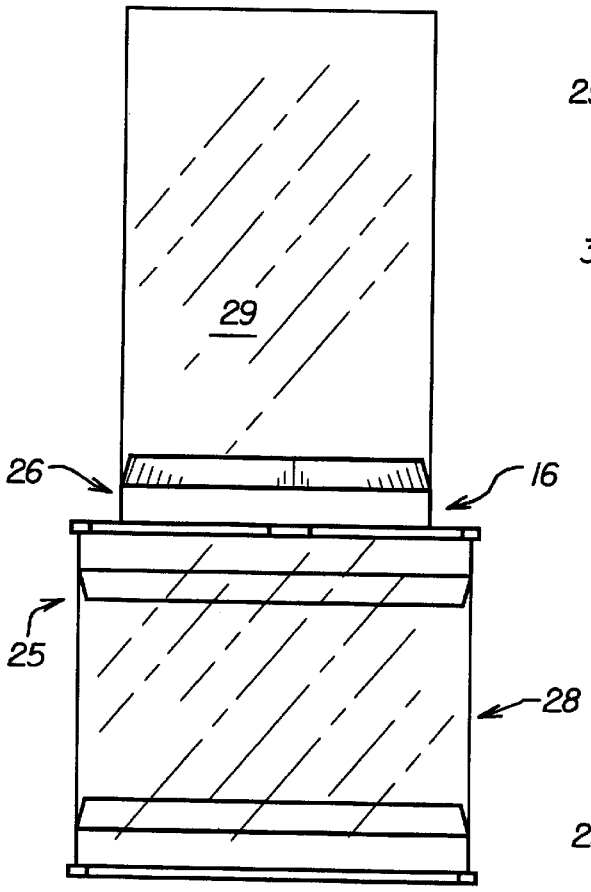
FIG. 10 is a side view of a second embodiment of a container having a dual closure cap of FIG. 5.
Figure 11:
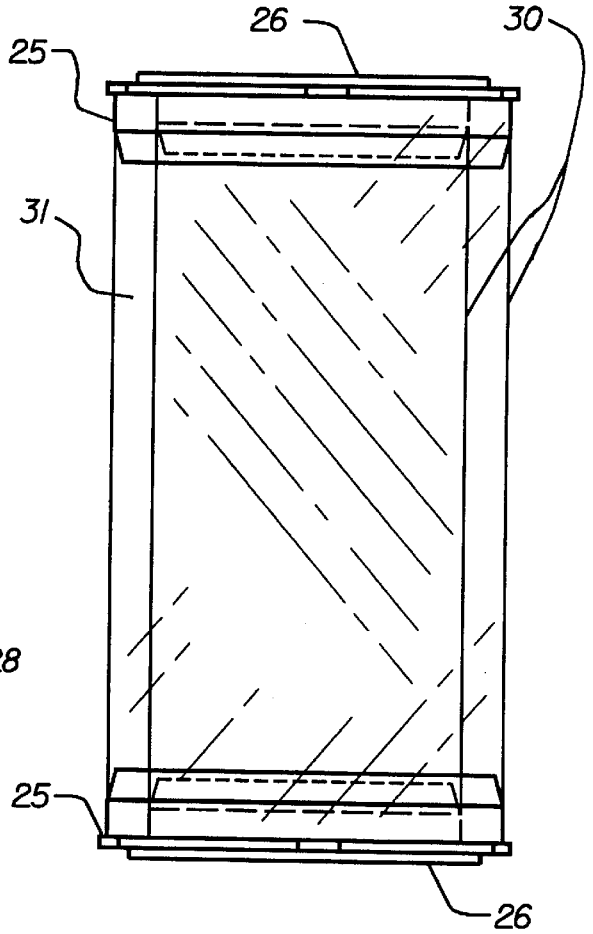
FIG. 11 is a side view of an embodiment of an elongated container having at each extremity a dual closure cap of FIG. 7.

The degree of taper or convergence of first band portion 17 is represented by convergence angle A, shown in FIG. 4. The value of said angle A is preferably between about 5 and 25 degrees. The degree of taper or convergence of second band portion 18 is represented by convergence angle B, shown in FIG. 4. The value of said angle B is preferably between about 0.5 and 3 degrees. The function of said first band portion is to facilitate the entrance of the closure cap into the open extremity of a tubular container or other circular opening. The function of said second band is to facilitate the secure interengagement of two caps of the present invention, as will be detailed hereinafter. The function of apogee ridge 19 is to secure strong frictional engagement with the interior surface of a tubular container 20, as shown in FIGS. 9–11. In view of the specialized functionality of outer surface 16, its exact construction and dimensional features are matters of critical importance in achieving the objectives of the present invention.

Flange 11 is transversely disposed to axis 12 as a flat panel defining a circular aperture 21 centered upon said axis. The diameter of aperture 21 is smaller than the diameter of inner surface 15, thereby forming an annular shoulder 22 which faces first extremity 13. Flange 11 is bounded by perimeter 23 outwardly directed from said axis and extending beyond outer surface 16 of collar portion 10. The illustrated embodiment of perimeter 23 is of a preferred, substantially hexagonal configuration. However, other polygonal and circular configurations are contemplated.

In another aspect of the present invention, a dual closure cap 24 is provided, as shown in FIGS. 5–8. In forming said dual closure cap, a first closure cap 25 of the aforesaid nature is engaged by a second closure cap 26 of similar construction but smaller dimensions than said first closure cap. In particular, the diameter of the apogee ridge of said second cap is substantially equal to the diameter of the circular aperture of said first cap. The "similar construction" of said second cap includes a construction identical to that of the first cap and a construction identical to the first cap with the exception that aperture 21 is omitted and instead replaced by a closure panel 33 which is a coplanar continuous extension of flange 11. The manner of interengagement of said caps is such that the collar portion of said second cap penetrates the central aperture of said first cap, and becomes locked in place by virtue of the tapered nature and dimensions of its second band portion 18 and the resilient nature of the collar portion. In such locked position, the flanges of both caps are in abutting relationship and considerable force is required to separate the caps.

Figure 5:
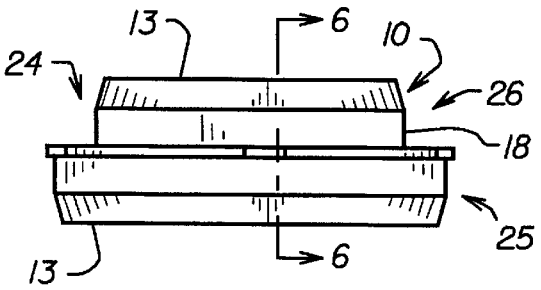
FIG. 5 is a side view of a first embodiment of a dual closure cap of the present invention.
Figure 6:
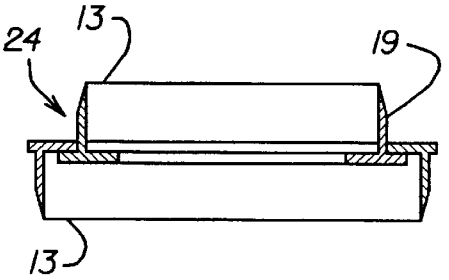
FIG. 6 is a sectional view taken in the direction of the arrows upon the line 6—6 of FIG. 5.

In the first dual closure cap shown in FIGS. 5 and 6, the two interactive caps are assembled in opposing directional relationship. The resultant dual cap has an upwardly directed collar portion 10. Typical utilization of such first dual closure cap is shown in FIGS. 9 and 10. In FIG. 9, the upwardly directed collar serves as retaining means for a spherical object such as golf ball 27. The underlying container 28, comprised of a plastic tube 30 which is preferably transparent, may serve to hold paper clips or other frequently needed small office supply items. Access to the interior of container 28 is accomplished either by removing the golf ball or the dual lid. In FIG. 10, an elongated upper tube 29 is attached to a lower container 28 by way of frictional engagement with the outer surface 16 of the second cap 26 of said first dual closure cap. The integrated and elongated container is useful for the storage of elongated frequently needed supply items such as pencils, pens, artists brushes, and drinking straws. It is also useful for the packaging of golf balls in the upper portion of the integrated container and golf tees in the lower, wide portion of the same container.

Figure 7:
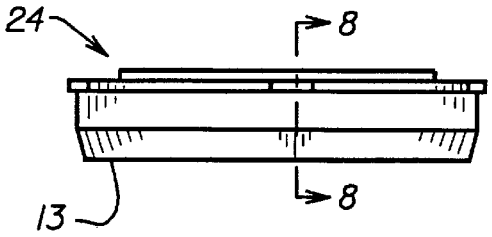
FIG. 7 is a side view of a second embodiment of the dual closure cap of this invention.
Figure 8:
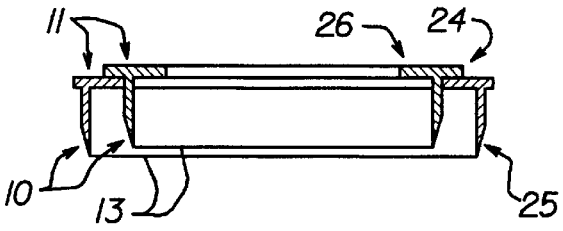
FIG. 8 is a sectional view taken in the direction of the arrows upon the line 8—8 of FIG. 7.

In the second embodiment of the dual closure caps of this invention, shown in FIGS. 7 and 8, the two interactive caps are assembled in co-directional relationship. The resultant dual cap has two downwardly directed collar portions 10 in concentric relationship. Typical utilization of such second dual closure cap is shown in FIG. 11, wherein two plastic tubes 30 are held in spaced apart concentric relationship by virtue of their spaced apart engagement with the separate collar portions. Such configuration creates an annular space 31 which may be caused to confine advertising indicia or attention-attracting moveable material such as souvenir sand, colored flakes, sea shells and ball bearings or BBs subject to magnetic manipulation. In such containers having two plastic tubes, whereas the outermost tube must be transparent for proper effectiveness, the inner tube may be transparent or opaque, or may be provided with a removable sleeve containing indicia for visual enhancement or advertising purposes. It is to be noted that, in this second embodiment of dual closure caps, wherein the separate caps are co-directional, additional caps can be involved, whereby a multiple closure cap of three or more separate cap components may be provided.

In the formation of the dual closure caps of this invention, the separate component caps may be of the same or different colors. Also, the smaller second closure cap 26, need not contain the central aperture possessed by the closure cap of this invention. Such variations further illustrate the versatility of the closure cap of the present invention. Specifically, the construction of the cap of this invention permits the production of multiple closure cap units of different configurations and different color combinations. Such various combinations cannot be achieved by way of a molding operation which would produce a monolithic multi-purpose cap, or if achievable, would be very costly because of the need for a multiplicity of molds.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A closure cap of monolithic construction for a tubular container, said cap comprising:

a) a collar portion of circular configuration with respect to a center axis, bounded by first and second extremities lying in parallel planes spaced apart in orthogonal relationship to said axis, an inner surface directed toward said axis and having a circular cylindrical contour with respect to said axis, and an opposed outer surface comprised of a first band portion convergently tapered toward said axis in the direction of said first extremity, and a second band portion convergently tapered toward said axis in the direction of said second extremity, said first and second band portions meeting in a circular apogee ridge representing the maximum diameter of said outer surface, and b) a flange transversely disposed to said axis and defining a circular aperture centered upon said axis and having a diameter smaller than the diameter of said inner surface, said flange having a perimeter directed outwardly from said axis and extending beyond said outer surface.

2. A dual closure cap comprised of a first closure cap as defined in claim 1 and a second closure cap of similar construction but smaller dimensions than said first closure cap wherein the diameter of the apogee ridge of said second cap is substantially equal to the diameter of the circular aperture of said first cap, said caps being interengaged in a manner whereby the collar portion of said second cap penetrates the central aperture of said first cap, and the flanges of both caps being in abutting relationship.

3. The dual closure cap of claim 2 wherein said caps are disposed in opposite relationship whereby the collar portion of said second cap is above the flange of said first cap and directed away from the collar portion of said first cap.

4. The dual closure cap of claim 2 wherein said caps are co-directionally disposed, causing the collar portion of said second cap to be located within the collar portion of said first cap in concentric relationship therewith.

5. The closure cap of claim 1 wherein the perimeter of said flange has a substantially polygonal configuration.

6. The closure cap of claim 5 wherein said polygonal configuration is hexagonal.

7. The closure cap of claim 1 wherein the perimeter of said flange is circular.

8. A container comprised of an elongated tubular member having opposite extremities disposed in parallel planes orthogonal to the direction of elongation, and a closure cap of claim 1 associated with at least one of said extremities.

9. The container of claim 8 wherein said tubular member is of transparent plastic construction.

10. A container comprised of an elongated tubular member having opposite extremities disposed in parallel planes orthogonal to the direction of elongation, and a dual closure cap of claim 2 associated with at least one of said extremities.

* * * * *